United States Patent [19]

Castles et al.

[11] Patent Number: 4,821,907

[45] Date of Patent: Apr. 18, 1989

[54] SURFACE TENSION CONFINED LIQUID CRYOGEN COOLER

[75] Inventors: Stephen H. Castles, College Park; Michael E. Schein, Crofton, both of Md.

[73] Assignee: The United States of America as represented by the Administrator of the National Aeronautics and Space Administration, Washington, D.C.

[21] Appl. No.: 205,771

[22] Filed: Jun. 13, 1988

[51] Int. Cl.[4] ..... F17C 11/00

[52] U.S. Cl. ..... 220/5 A; 220/901; 62/45; 62/48; 206/0.7

[58] Field of Search ..... 220/5 A, 901, 902, 855; 206/0.6, 0.7; 62/45, 48

[56] References Cited

U.S. PATENT DOCUMENTS

| | | | |
|---|---|---|---|
| 2,662,379 | 12/1953 | Reich | 62/1 |
| 2,663,626 | 12/1953 | Spangler | 48/190 |
| 3,045,437 | 7/1962 | Aronson | 62/45 X |
| 3,069,042 | 12/1962 | Johnston | 220/901 X |
| 3,108,445 | 10/1963 | Portzer et al. | 62/48 |
| 3,280,593 | 10/1966 | Konkel | 62/514 |
| 3,315,478 | 5/1967 | Walsh et al. | 62/45 |
| 3,407,615 | 10/1968 | Klipping | 62/45 |
| 3,950,960 | 5/1976 | Kawam | 62/48 |
| 4,096,639 | 6/1978 | Sandrock | 34/15 |
| 4,185,979 | 1/1980 | Woolley | 62/48 |
| 4,249,654 | 2/1981 | Helversen | 206/0.7 |
| 4,341,078 | 7/1982 | Weitzen | 62/48 |
| 4,383,606 | 5/1983 | Hunter | 206/0.7 |
| 4,393,924 | 7/1983 | Asami et al. | 165/104.12 |
| 4,433,063 | 2/1984 | Bernstein et al. | 502/402 |
| 4,481,779 | 11/1984 | Barthel | 62/48 |
| 4,489,564 | 12/1984 | Häusler et al. | 62/48 |
| 4,495,775 | 1/1985 | Young et al. | 206/0.7 X |
| 4,674,563 | 6/1987 | Maier-Larhuber et al. | 165/104.12 |
| 4,716,736 | 1/1988 | Schwarz | 62/48 |
| 4,750,631 | 6/1988 | Hastings et al. | 220/5 A X |

OTHER PUBLICATIONS

Michael E. Schein, "Development of a Space Qualified Surface Tension Confined Liquid Cryogen Cooler (STCLCC)", Jun. 14–18, 1987; reprinted in Advances in Cryogenic Engineering, vol. 33, edited by R. W. Fast, pp. 819–826, published in 1988 by Plenum Press.

*Primary Examiner*—Steven M. Pollard

*Attorney, Agent, or Firm*—R. Dennis Marchant; John R. Manning; Alan J. Kennedy

[57] ABSTRACT

A cryogenic cooler is provided for use in craft such as launch, orbital and space vehicles subject to substantial vibration, changes in orientation and weightlessness. The cooler contains a small pore, large free volume, low density material to restrain a cryogen through surface tension effects during launch and zero-g operations and maintains instrumentation within the temperature range of 10°–140° K. The cooler operation is completely passive, with no inherent vibration or power requirements.

22 Claims, 1 Drawing Sheet

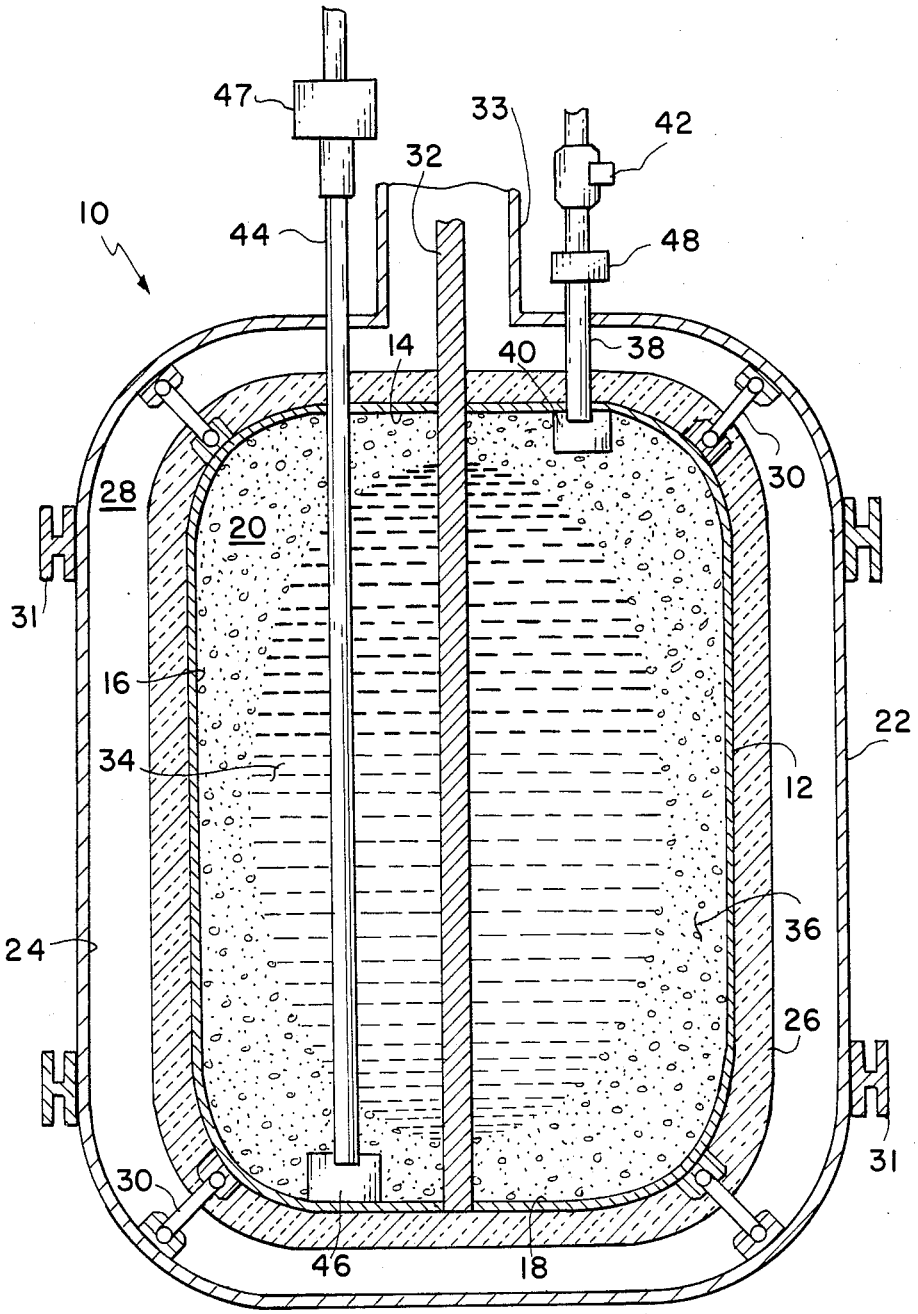
47
33
42
32
10
44
48
14
40
38
30
28
20
31
16
22
34
12
36
24
26
31
30
46
18

SURFACE TENSION CONFINED LIQUID CRYOGEN COOLER

ORIGIN OF THE INVENTION

The invention described herein was made by an employee of the United States Government and may be manufactured and used by or for the government for governmental purposes without the payment of the royalties thereon or therefor.

FIELD OF THE INVENTION

The present invention relates generally to coolers having containers or dewars for cryogens and more particularly to containers for cryogenic liquid coolers useful in applications involving the cooling of instrumention in space.

BACKGROUND OF THE INVENTION

The requirements of satellite and space probe borne super cooled instrumentation for cryogenic cooling fluids necessitate provision for containing the necessary cryogen supply during launch and for periods up to a year or more, thereafter. An example of such an instrument is an infrared sensor which requires cryogenic liquid cooling to obtain optimum infrared radiation sensitivity. Such on-orbit instrumentation must be maintained at temperatures of typically 10°-140° K. The use of cryogens avoids the power usage and complexity of a powered cooling system.

Prior art orbital cryogenic systems required maintenance of the cryogen in the frozen state. If the cryogen is allowed to liquify, the vent port of the cooler can become blocked with liquid, resulting in the liquid being immediately pumped out to space, depleting of cryogen and introducing safety hazards at the vent exhaust. This condition can readily occur due to vibration during launch and weightlessness during orbit. Freezing of the cryogen requires cooling coils, coolant supply, and regulation equipment and instrumentation to assure operators that the cryogen is maintained in a frozen state, adding weight and complexity to the spacecraft. Since the frozen cryogen must be kept at a vapor pressuer below its triple point, generally below one atmosphere of pressure, a pumping system must be incorporated if the solid cryogen is to be maintained on the launch pad beyond the limited amount of time before heat leak of the system results in cryogen melting. These pumping systems are heavy, require power, add complexity to the system design and operation, decrease system reliability, and create safety problems. Without such pumping systems, the launch vehicle carrying the cryogenic device can remain on the launch pad for only a limited amount of time without servicing of the frozen cryogen dewar. Procedures to freeze and subcool the cryogen also add complexity and time to launch pad operations, which are normally time and safety critical. Another drawback of the frozen cryogen system is that its cryogen cannot be replenished in orbit or in space by service vehicles, a requirement if sensors are to remain useful beyond a relatively short time in space. The above-mentioned disadvantages and limitations of the prior art frozen cryogenic system could be overcome if a practical liquid cryogen system could be provided.

SUMMARY OF THE INVENTION

It is therefore an object of the present invention to provide an improved cryogenic cooling system for cooling space based super cooled instruments wherein the requirement for maintaining the cryogen in the frozen state is eliminated.

It is another object of the invention to provide an improved cryogenic dewar system capable of operating with a liquid cryogen supply while avoiding the chance of uncontrolled loss of liquid through the vent under launch and orbital conditions.

It is a still further object of the invention to provide an improved cryogenic cooling system which can remain on the launch pad for extended periods of time without provision for cooling coils and pumping systems, or cooler servicing.

The foregoing and other objects are accomplished by providing a cooler, according to the present invention, containing a high surface area, low density open cell material such as ceramic or carbon "sponge" substantially throughout the contained volume therein. When the dewar according to the present invention is filled with cryogenic fluid, the cryogenic is acquired by the sponge material and held in place due to the surface tension properties of the cryogen. This technique has been used in cryogenically frozen biomedical specimen shipping containers for terrestrial use; however, these shipping containers do not use zero gravity effects to favorably orient the cryogen, they do not directly use the cooling power of the liquid phase of the cryogen for precise temperature control, and they do not use a cold finger to allow cooling of remote instrumentation which is not actually situated with the dewar. All of these capabilities are original and critical to the operation of this invention. In the present invention, the liquid cryogen is kept away from the vent while the dewar is undergoing launch or zero-gravity operations and is forced to make good thermal contact with an internal cold finger inside the dewar. The "sponge" filled dewar according to the present invention overcomes the above-mentioned disadvantages of the prior art system in an inherently simple, reliable, and inexpensive device which will result in reduced costs, enhanced reliability and safety, and fewer ground servicing requirements for the launch vehicle. The inventive cooler system will provide serviceability on-orbit, which will be a wholly new capability for space borne cryogenic systems. This serviceability is extremely important to planned long duration on-orbit facilities. On the launch pad, the liquid cooler system can be replenished, a capability that is advantageous where long pre-launch delays are common, such as for the manned space shuttle.

BRIEF DESCRIPTION OF THE DRAWING

The specific nature of the invention, as well as other objects, aspects, uses and advantages thereof, will clearly appear from the following description and from the accompanying drawing, in which:

The FIGURE is a cross-sectional view in elevation illustrating the liquid containing cryogenic cooler according to the present invention.

DESCRIPTION OF THE PREFERRED EMBODIMENT

Referring now to the figure, which illustrates a surface tension contained liquid cryogen cooler 10 according to this invention. Cooler 10 is formed by a generally cylindrical inner tank 12 having upper wall 14, sidewall, 16, and lower wall 18 defining an interior space 20. Outer vacuum shell 22 is located exterior to and generally conformal to inner tank 12 and is made up of outer wall 24 and contains insulation layer 26. Insulation layer 26 is located in intimate contace with inner tank 12 and is spaced inward from outer wall 24 to form vacuum void 28. Inner tank 12 is secured within vacuum shell 22 by means of a low thermal conductivity inner tank support system 30, shown here as a strap, but which may also be struts, truss, or beam. Mounting rings 31 attached to the outer vacuum shell 22 allow the cooler 10 to be attached to the spacecraft containing the instrumentation to be cooled.

Cold finger 32 is mounted along the center axis of inner tank 12. Cold finger 32 is generally cylindrical in shape and extends from outside cooler 10 through inner tank 12 into and along the axis of cylindrical vacuum sleeve jacket 33. Cold finger 32 is effective to transfer heat from exterior sources, such as instrument detectors, along its length to the liquid cryogen 34 contained within the porous sponge 36. The liquid cryogen 34 is shown surrounding the cold finger 32 in a typical zero-g orientation.

Sponge 36 is located and extends substantially throughout interior space 20 of inner tank 12 and is effective to maintain the contained liquid cryogen in a fixed position relative to the cooler 10 through the liquid's surface tension properties.

Vent tube 38 is generally cylindrical and extends in fluid communication with vent void space 40 in sponge 36 located within the upper portion of interior space 20 through upper wall 14 of inner tank 12 and through outer vacuum shell 22 to the atmosphere and is effective to vent vaporized cryogen from cooler 10. A pressure regulator 42 is positioned within vent tube 38 to maintain system pressure at a desired level to maintain the cryogen in the liquid state, i.e., above its triple point, when vented to open space. Pressure regulator 42 may be an absolute type for maintaining a precise operating temperature, or a check valve, where variation in operating temperature is acceptable. Fill tube 44 is generally cylindrical and extends in fluid communication with fill flow relief space 46 through upper wall 14 of inner tank 12 and through outer vacuum shell 22 to allow filling inner tank 12 of cooler 10 with cryogenic fluid. A cryogenic fluid coupler 47 is included to allow repeated servicing of cooler 10.

In operation, heat is transferred from a satellite mounted sensor through cold finger 32 to the liquid cryogen maintained within cooler 10. Vaporized cryogen resulting from this heat transfer is vented through vent tube 38 to the atmosphere.

Sponge 36 is a high surface area, low density open cell material which is preferably rigid and is capable of acquiring and holding in place liquid cryogen, due to the high surface tension of the cryogen with the sponge. A preferable sponge material is a micropore ceramic, composed of silicon, with free volume of 95% or greater, such as that designated as H.T.P.—6, which is available from Lockheed Missile and Space Company, Sunnyvale, CA. This material is more widely known for its use as thermal protection tile on the space shuttle. While the ceramic sponge material is remarkably durable, it is composed of brittle microscopic fibers which could be a source of particulate contaminates in the vent gas. A variety of steps can be taken to avoid vent gas contamination. That shown is a conventional filter 48 on the vent line 38 upstream of pressure regulator 42.

Tank 12, shell 22 and other structural features can be made of suitable metal, glass, composite or ceramic materials as is known in the art. In the embodiment shown, inner tank 16 and vacuum shell 24 is made of aluminum, support system 30 is a series of fiberglass support straps, and cold finger 32 is copper. Insulation layer 26 can be of any desired insulating material and may be disposed in single or multiple layers. Outer vacuum shell 22 is so disposed and configured within cooler 10 as to maintain a vacuum and thus further minimize heat load on inner tank 12 from the environment.

It will be understood by those skilled in the art that the embodiment shown and described is only exemplary and that various modifications can be made in the practice of the invention within the scope of the appended claims.

We claim:

1. A cryogenic cooler for use in craft such as launch, orbital and space vehicles subject to changes in orientation and conditions of vibration and weightlessness comprising:

an insulated tank;

a porous open celled sponge-like material disposed substantially throughout the contained volume of said insulated tank;

a cryogenic fluid disposed within said sponge-like material;

a cooling finger immersed in said cryogenic fluid, said finger extending from inside said insulated tank externally to an outside source such as an instrument detector for the purpose of transmitting heat from said outside source into said cryogenic fluid;

means for filling said insulated tank with cryogenic fluid; and means for venting vaporized cryogenic fluid from said insulated tank;

wherein said sponge-like material is of such pore size that the surface tension of said cryogenic fluid is effective to maintain said liquid cryogenic fluid suspended within said sponge-like material during conditions of vibration, changes in said cooler orientation and zero gravity environments, and wherein heat entering said cooling dewar through said cooling finger is conducted at a precise temperature through said cooling finger and therefrom into said cryogenic fluid contained within said tank, said heat being dissipated by vaporization and expulsion of cryogen through said vent means.

2. The cryogenic cooler of claim 1 wherein said contained open cell sponge element is rigid, open cell ceramic material having a pore size sufficiently small to provide adequate surface tension effect.

3. The cryogenic cooler of claim 2 wherein said ceramic sponge element has a free volume of substantially 95 percent.

4. The cryogenic cooler of claim 1 wherein said inner tank design orients the liquid phase of the cryogen around the cold finger heat transfer device.

5. The cryogenic cooler of claim 1, wherein said cooling finger is made of a material that has high thermal conductivity.

6. The cryogenic cooler of claim 1, wherein said inner tank and said cooling finger are combined as one integral unit.

7. The cryogenic cooler of claim 1 wherein said means for venting vaporized cryogenic fluid from insulated tank comprises a vent tube.

8. The cryogenic cooler of claim 7, wherein said vent tube has a pressure regulator therein to maintain the system pressure at a desired level to maintain the cryogen in the liquid state.

9. The cryogenic cooler of claim 8, wherein said vent tube has a filter installed therein upstream of said pressure regulator.

10. The cryogenic cooler of claim 8 wherein said pressure regulator is a check valve.

11. The cryogenic cooler of claim 1 wherein said means for filling said insulated tank comprises a fill tube.

12. The cryogenic cooler of claim 11 wherein said fill tube includes a cryogenic fluid coupler to allow for repeated servicing of said cooler.

13. The cryogenic cooler of claim 1 wherein said insulated tank is surrounded by a shell wherein an open spaced area between said shell and insulated tank is evacuated.

14. The cryogenic cooler of claim 13 wherein said insulated tank is supported within said shell by a support means that has low thermal conductivity.

15. The cryogenic cooler of claim 14 wherein said support means is a truss system.

16. The cryogenic cooler of claim 14 wherein said support means is a strap system.

17. The cryogenic cooler of claim 14 wherein said support system is a beam system.

18. The cryogenic cooler of claim 14 wherein said shell includes mounting rings attached to the outside surface of said shell to allow said cryogenic cooler to be attached to said spacecraft.

19. A process for cooling spaced based instruments for use in craft such as launch, orbital and space vehicles subject to changes in orientation and conditions of vibration and weightlessness which comprises:

placing a liquid cryogen in an insulated tank having a porous open-celled sponge-like material disposed substantially throughout the contained volume of said insulated tank, wherein said sponge-like material is of such pore size that the surface tension of said liquid cryogen is effective to maintain said liquid cryogen suspended within said sponge-like material during conditions of vibration, changes in cooler orientation and zero-gravity environments;

placing one end of a cooling rod within said liquid cryogen;

attaching the opposite end of said cooling finger to instrumentation located external to said cooler, thereby enabling heat generated by said instrumentation to transfer to said cooling rod, and subsequently transfer heat from said cooling rod to said liquid cryogen;

venting any vaporized cryogen formed by the heat transferrred into said cryogen away from said insulated tank such that the temperature of the liquid cryogen, cooling rod and instrumentation remains at a predetermined level.

20. The method of claim 19 wherein the liquid phase of the cryogen is made to surround the cooling rod heat transport device, providing a full-time, precise and known temperature to the instrumentation to be cooled.

21. The method of claim 19 wherein the internal pressure of said tank is maintained at a desired value by means of the operation of a pressure regulator disposed in said vent so as to keep said cryogenic fluid above its triple point temperature while being exposed to said variable external pressure.

22. The method of claim 19 wherein said open cell sponge element is rigid silicon ceramic having a micropore internal structure.

* * * * *